US006308475B1

(12) United States Patent
Crish, II et al.

(10) Patent No.: US 6,308,475 B1
(45) Date of Patent: Oct. 30, 2001

(54) SILL FOR SUPPORTING WALL PANEL

(75) Inventors: Thomas A. Crish, II, Youngstown; Jack Marstellar, Austintown, both of OH (US); Mark Back, Myrtle Beach, SC (US)

(73) Assignee: Modern Builders Supply, Inc., Toledo, OH (US)

( * ) Notice: Subject to any disclaimer, the term of this patent is extended or adjusted under 35 U.S.C. 154(b) by 0 days.

(21) Appl. No.: 09/491,262

(22) Filed: Jan. 26, 2000

(51) Int. Cl.[7] ..... E06B 1/26; E06B 7/00

(52) U.S. Cl. ..... 52/204.597; 52/202; 52/211; 52/215; 52/730.5; 49/408; 49/471; 49/504

(58) Field of Search ..... 52/200, 204.1, 52/204.597, 204.67, 204.705, 204.72, 277, 204.57, 235, 204.5, 211, 215, 730.3–730.5; 49/484, 495, 504, 408, 471

(56) References Cited

U.S. PATENT DOCUMENTS

| | | | | |
|---|---|---|---|---|
| D. 42,536 | | 5/1912 | Jay et al. . | |
| D. 243,682 | | 3/1977 | Dallaire . | |
| D. 244,382 | | 5/1977 | Scheid . | |
| D. 283,352 | | 4/1986 | Bancroft . | |
| D. 435,670 | * | 12/2000 | Crish, II et al. | D25/124 |
| 3,420,016 | | 1/1969 | Findlay . | |
| 3,925,952 | | 12/1975 | Hagel et al. . | |
| 3,998,027 | | 12/1976 | Wendt et al. . | |
| 4,000,597 | | 1/1977 | Burton . | |
| 4,525,966 | * | 7/1985 | Litchfield et al. | 52/397 |
| 5,067,279 | * | 11/1991 | Hagemeyer | 49/471 |
| 5,212,921 | * | 5/1993 | Unruh | 52/204.1 |
| 5,295,335 | | 3/1994 | Collier . | |
| 5,341,600 | * | 8/1994 | Heppner | 49/471 |
| 5,560,155 | | 10/1996 | Back . | |
| 5,720,577 | | 2/1998 | Sanders et al. . | |
| 5,746,032 | * | 5/1998 | Koike et al. | 52/204.1 |
| 5,771,640 | | 6/1998 | Back . | |
| 5,857,298 | * | 1/1999 | Fullwood | 52/202 |
| 5,887,387 | * | 3/1999 | Dallaire | 49/408 |

* cited by examiner

*Primary Examiner*—Yvonne M. Horton
(74) *Attorney, Agent, or Firm*—MacMillan, Sobanski & Todd, LLC

(57) ABSTRACT

A sill for supporting a wall panel such as window panels for a modular solarium comprises a forward or outer sill, an intermediate rail, an inner channel, and an inner flange. The intermediate rail extends laterally inward from the outer sill. The rail includes a ramp and a raised surface. The ramp defines an outermost portion of the rail and extends upwardly from the outer sill to the raised surface. The rail terminates at the channel. The channel extends laterally between the rail and the flange. The bottom of a wall panel fits over the rail and has an inner leg which extends into the channel. Fasteners secure the inner leg on the wall panel to the inner flange.

17 Claims, 2 Drawing Sheets

SILL FOR SUPPORTING WALL PANEL

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to building construction, and more particularly to a sill for supporting wall panels. Most particularly, the invention relates to a sill for receiving and retaining the edge of modular solarium wall panels.

The increasing popularity of solariums has lead to the development of products that permit solariums to be constructed more expediently. One such product is the prefabricated solarium wall panel, as shown in U.S. Pat. No. 5,560,155 and U.S. Pat. No. 5,771,640. Properly locating and securing the wall panels to supporting structure is an important aspect of their installation, as is the case with virtually any building construction product. Locating and securing the wall panels in a proper horizontal and vertical position may often be cumbersome and time consuming.

In almost all forms of building construction, prevention of water migration from the exterior of the building structure to the interior of the building structure is critical. This is an important issue that must be addressed especially with regard to the lower edge of wall panels. It is obvious that water resulting from rain or condensation flows downward along the wall panel. This water has a tendency to collect along the lower edge of the wall panel if proper drainage is not provided.

Providing drainage along the lower edge of the wall panel does not always address the issue of water migration. For example, in windy conditions water collecting along the lower edge of the wall panel may be blown inwardly from the exterior of the building structure to the interior of the building structure before it has a chance to drain. Moreover, when freezing conditions prevail, water along lower edge of the wall panel may expand inwardly towards the interior of the building structure.

A need exists for less cumbersome, more expedient installation of wall panels that further reduces the risk of moisture migration between the exterior of a building structure and the interior of the building structure.

BRIEF SUMMARY OF THE INVENTION

The present invention is directed towards a sill for supporting a wall panel, such as modular panels forming a solarium. The sill comprises a forward or outer sill, an intermediate rail, an inner channel, and an inner flange. The intermediate rail extends laterally inward from the outer sill. The rail has a ramp and a raised surface. The ramp defines an outermost portion of the rail and extends upwardly from the outer sill to the raised surface. The intermediate rail terminates at the channel. The channel extends laterally between the rail and the flange.

Various objects and advantages of this invention will become apparent to those skilled in the art from the following detailed description of the preferred embodiment, when read in light of the accompanying drawings.

DETAILED DESCRIPTION OF THE INVENTION

Figure 1:
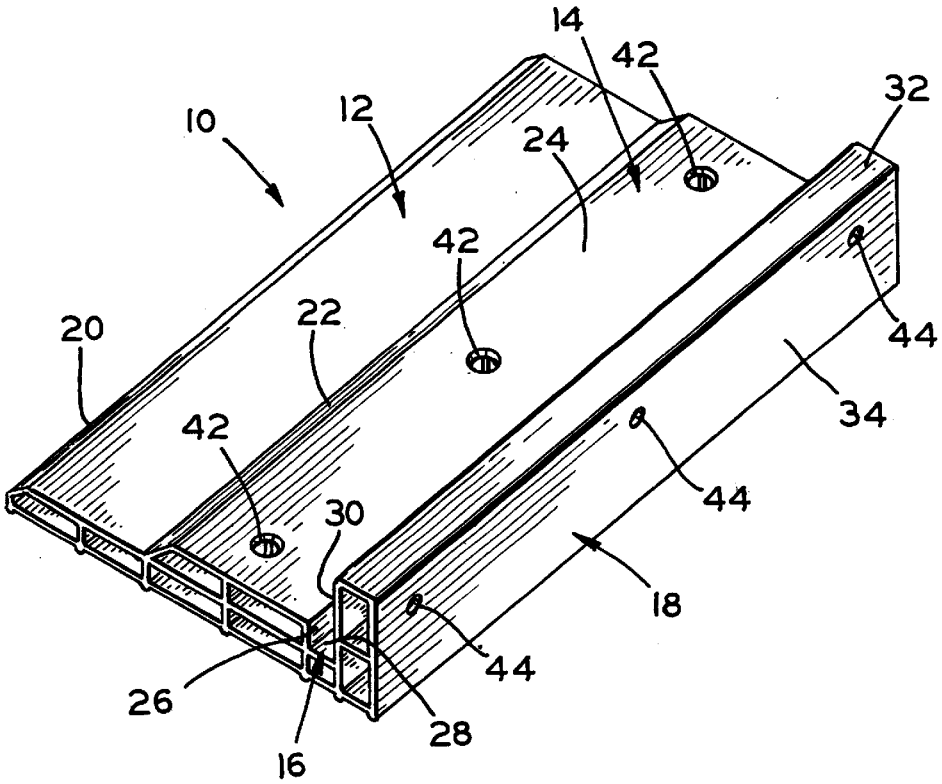
FIG. 1 is a perspective view of a sill according to the invention.

Now with reference to the drawings, there is illustrated in FIG. 1 a sill 10. The sill 10 is a longitudinally structure comprised of a forward or outer surface 12, an intermediate raised rail 14, an inner channel 16, and an inner barrier or flange 18. The terms "forward" and "outer" used throughout the description that follows are with respect to the exterior of the sill 10, generally indicated at E in FIG. 3. The terms "rear" and "inner" are with respect to the interior of the sill 10, generally indicated at I in FIG. 3.

Continuing with reference to FIG. 1, the outer surface 12 extends laterally inward from an outer edge 20 of the sill 10. The purpose of the outer surface 12 is to provide support for an outer leg 46 of a wall panel 48 (shown in FIG. 3). The term "wall panel" throughout the description may include solid walls, windows, window panels, and the like. The sill 10 is particularly useful for supporting solarium wall panels. The outer surface 12 forms a surface for upon which rain or moisture may drain outwardly and away from the wall panel 48. Although the outer surface 12 is substantially planar and horizontal in construction, the outer surface 12 may be angled downward and outward so as to further facilitate in draining moisture.

The outer surface 12 preferably terminates at the rail 14. More particularly, the outer surface 12 terminates at the base (shown but not referenced) of a ramp 22 which defines an outermost portion of the rail 14. The ramp 22 extends upwardly from the outer surface 12 to a raised surface 24. The ramp 22 is intended to form a barrier against moisture. The angle and extent of the ramp 22 are preferably sufficient to reduce the risk that moisture will traverse the ramp 22 and reach the raised surface 24. For example, the ramp 22 should prevent moisture from being blown onto the raised surface 24 under windy conditions. The ramp 22 should also prevent freezing moisture from expanding to the raised surface 24 in freezing temperatures. Although the invention is provided with a ramp 22, some other structure may be suitable for preventing moisture from reaching the raised surface 24.

Figure 3:
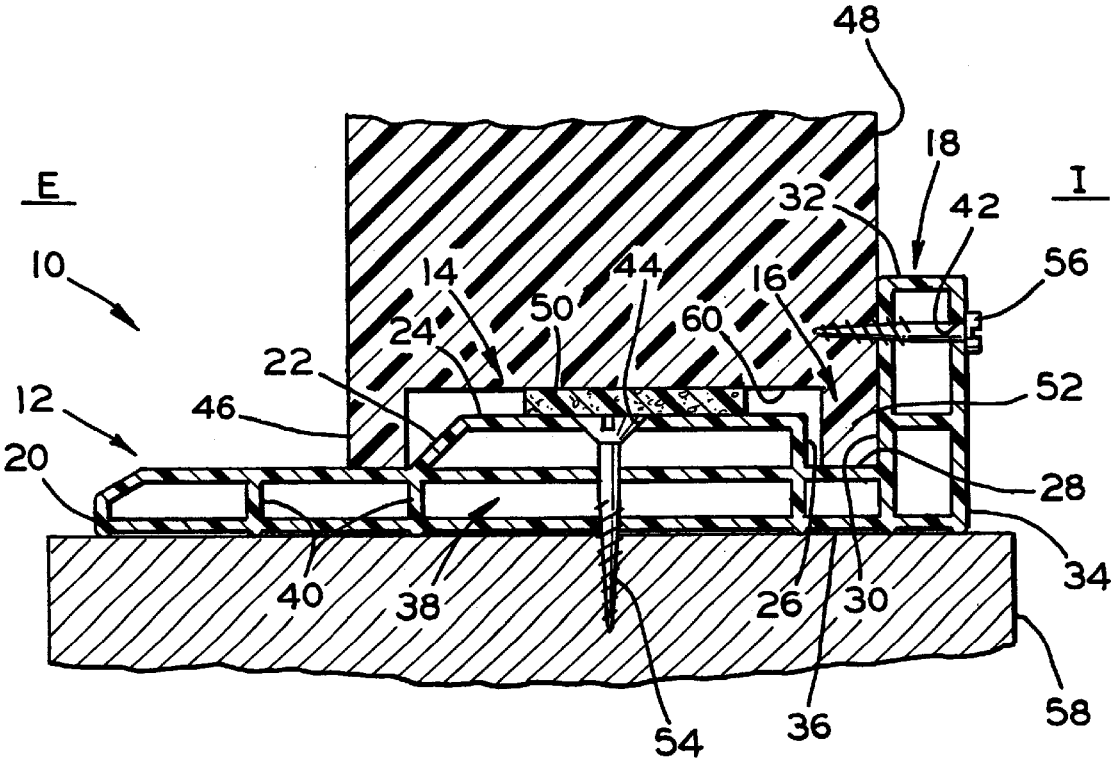
FIG. 3 is fragmentary cross sectional view of the sill secured to a support structure and with an attached wall panel according to the invention.

The raised surface 24 extends laterally from the crest (shown but not referenced) of the ramp 22 and may preferably support an insulating material 50, such as a bead of caulk or a foam strip (shown in FIG. 3). The insulating material 50 is preferably slightly compressible upon seating the wall panel 48 upon the sill 10, as will become apparent in the description that follows. The insulating material 50 forms an air, moisture and insect barrier between the interior I and the exterior E of the sill 10 (also shown in FIG. 3).

The raised surface 24 preferably terminates at an inner edge 26 of the rail 14. The ramp 22, the raised surface 24 and the inner edge 26 form the rail 14. Although the inner edge 26 has a substantially vertical orientation, other orientations may be suitable for carrying out the invention. Moreover, the invention may be practiced with some structure other than the inner edge 26 shown.

The inner edge 26 extends from a terminal edge (shown but not referenced) of the raised surface 24 to a lower surface 28, which, in part, forms the channel 16. The lower surface 28 of the channel 16 extends laterally from the lower end (shown but not referenced) of the inner edge 26 to a lower end of an opposing outer facing surface 30. The inner edge 26, the lower surface 28 and the outer facing surface 30 cooperatively define a space which forms the channel 16.

The channel 16 is provided for receiving an inner leg 52 of the wall panel 48. The lower surface 28 of the channel 16 is intended to provide support for the inner leg 52 of the wall panel 48, which will become more apparent in the description below.

The outer facing surface 30 preferably extends above the raised surface 24 or beyond the inner edge 26 of the rail 14. The outer facing surface 30 preferably intersects and terminates at an elevated surface 32.

As can been seen in the drawings, the elevated surface 32 has a greater elevation than the raised surface 24 of the rail 14. The outer facing surface 30, the elevated surface 32, and an inner facing 34, opposing the outer facing surface 30, cooperate to form the inner flange 18.

The flange 18 is intended to provide an abutment surface for the inner leg 52 of the wall panel 48. The flange 18 may be provided with spaced holes 44 through which fasteners may pass. Fasteners, such as the threaded fastener 54 (shown in FIG. 3), may pass through the holes 44 and threadably engage the wall panel 48 to draw the wall panel 48 against the flange 18. This will become apparent in the description that follows.

As is clearly shown in FIG. 1, the sill 10 also may be provided with longitudinally spaced holes 42, preferable through the rail and near a center line along the sill 10. These holes 42 are provided for receiving fasteners 56 for securing the sill 10 to a supporting structure 58 (FIG. 3).

Figure 2:
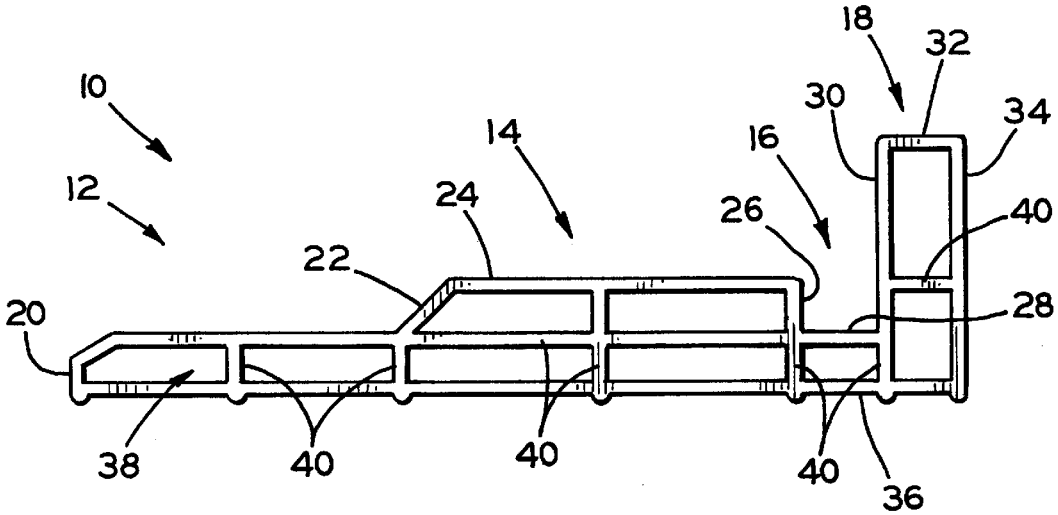
FIG. 2 is a cross sectional view of the sill shown in FIG. 1.

As is shown in the cross section in FIG. 2, the sill 10 may be an extruded material, such as a durable plastic or aluminum. The sill 10 is most preferably constructed in the form of a PVC plastic extrusion. The sill 10 has a hollow interior 38. Webbing 40 interposed in the hollow interior 38 provides structural support for the sill 10 in both vertical and horizontal directions. Although an extruded sill 10 is shown, other constructions may be suitable for carrying out the invention. For example, the sill 10 may be in the form of a solid (not shown) as opposed to an extrusion. An extruded sill, however, would consume less material and thus, should be less costly to produce.

The use of the invention is best understood with reference to FIG. 3. There is illustrated a sill 10 mounted to a building structure. The sill 10 may be anchored directly to a footer or foundation (not shown), to a wood deck (not shown), or atop the top of a wall, such as a knee wall or a wall that forms the bottom of a window opening (not shown). It can be seen that the sill 10 may be mounted to the supporting structure 58. The supporting structure 58 may be, for example, in the form of a 1×6 wood trim strip on the top of a low wall. The sill 10 may be an indeterminate length so as to be cut to fit. Alternatively, sills 10 may be varying determinate lengths and, if necessary, a number of sills 10 may be joined together along a common axis.

It should be noted that the holes 44 in the rail 14 may be tapered and the fasteners 56 for fastening the sill 10 to the supporting structure 58 may likewise have a tapered head so that the fasteners 56 may be countersunk in the holes 44. This permits the wall panel 48 to rest flush against the rail 14 without interference from the fasteners 56. Before securing the sill 10 to the supporting structure 58, suitable caulking or a resilient rubber pad may be placed either on the bottom or underside 36 of the sill 10 or on the supporting structure 58 for forming a moisture, air and insect barrier between the sill 10 and the supporting structure 58 along the length of the sill 10. This is particularly important if the supporting structure is an irregular surface, such as the top of a brick wall or a concrete floor.

It also may be desirable to run a bead of caulk (not shown) longitudinally along the rail 14 prior to placing the wall panel 48 over the rail 14. This provides a barrier against moisture, air and insects passing between the wall panel 48 and the sill 10. It is most preferable that a strip of self-adhesive foam insulation 50 be affixed axially along the rail 14, as shown in the drawings. This likewise provides a moisture, air and insect barrier or seal between the interior and exterior between the wall panel 48 and the sill 10 along the length of the sill 10.

As is seen in the drawings, in addition to preventing the migration of moisture to the interior of the wall panel 48, the rail 14 facilitates in positioning the wall panel 48 centrally over the rail 14, and thus, centrally on the sill 10.

The bottom of the wall panel 48 is formed with a groove 60 separating an outer leg 46 and an inner leg 52. The groove 60 is sized to fit over the rail 14 and the inner leg 52 fits into the channel 16. The inner leg 52 may be secured to the sill 10 with fasteners 54. This can be accomplished by inserting the fasteners 54 into the holes 42 in the flange 18 along the interior of the sill 10 and threading the fasteners 54 into the inner leg 52 of the wall panel 48. The fasteners 54 may be any suitable fastener, including self-tapping screws commonly referred to as "tappits." The fasteners 54 may be tightened to draw the wall panel 48 tightly against the flange 18. Obviously, the wall panel 48 also may be secured to a vertical support structure, such as wall studs or beams (not shown), or trim plates secured within a window opening (not shown).

As shown in the drawings, the wall panel 48 rests snugly against the sill 10 by force of gravity, at least slightly compressing the foam strip insulation 50, and tightly against the flange 18 via fastener 54. The ramp 22 is provided to resist flow of moisture inwardly and should moisture be blown up the ramp 22, the ramp 22 is sloped so that the moisture will flow back downward and outward away from the raised surface 24 of the rail 14.

It should be clearly understood that the channel 16 may be structured and dimensioned to accommodate wall panels 48 having various structural characteristics. As stated above, the purpose of the channel 16 is to receive an inner leg 52 of the wall panel 48. The inner leg 52 may be of varying shapes and dimensions. The channel 16 may be suitably structured and dimensioned to accommodate a multitude of configurations of the wall panel leg 52.

Although the invention is shown supporting the lower edge of a wall panel 48, it is conceivable that the invention may be useful in supporting any and all edges of the wall panel 48.

The principle and mode of operation of this invention have been explained and illustrated in its preferred embodiment. However, it must be understood that this invention may be practiced otherwise than as specifically explained and illustrated without departing from the following claims.

What is claimed is:

1. A one piece extruded sill for supporting a wall panel having a grooved edge, said sill having an outer surface adjacent an outer edge and spaced from an inner surface, an intermediate rail extending laterally inward from said outer surface towards said inner surface, said intermediate rail having a raised surface adapted to fit into a grooved edge of a wall panel, a channel, said intermediate rail terminating at said channel; and an inner flange, said channel extending laterally between said intermediate rail and said inner flange, said inner flange having an elevation greater than said intermediate rail and terminating at said inner surface.

2. The sill of claim 1, wherein the outer surface is substantially horizontal in construction.

3. The sill of claim 1, wherein the outer surface is at least partially angled downwardly and outwardly adjacent said outer edge so as to facilitate in draining moisture.

4. The sill of claim 1, wherein said intermediate rail has a ramp adjacent said outer surface extending upwardly from said outer surface to said raised surface, said ramp having an angle sufficient to prevent moisture from migrating to said raised surface.

5. The sill of claim 4, wherein said raised surface extends laterally inward from said ramp to said inner channel.

6. The sill of claim 1, wherein said raised surface is adapted to support an air barrier.

7. The sill of claim 6, wherein said air barrier is an insulating material.

8. The sill of claim 7, wherein said insulating material is a compressible foam strip.

9. The sill of claim 1, wherein said intermediate rail further includes a substantially vertical inner edge which extends from said raised surface to a lower surface of said channel.

10. The sill of claim 1, wherein said inner flange is provided with at least one hole through which a fastener may pass for securing a wall panel to said inner flange.

11. The sill of claim 1, further comprising at least one hole for receiving a fastener for securing said sill to a supporting surface.

12. The sill of claim 1, wherein said sill is a PVC extrusion.

13. The sill of claim 12, wherein said extruded sill has a hollow interior and structural support webbing interposed in the hollow interior.

14. A one piece extruded sill for supporting a wall panel having an edge groove extending between an outer leg and an inner leg, said sill having an outer surface adjacent an outer edge and spaced from an inner surface, an intermediate rail extending laterally inward from said outer surface towards said inner surface, said intermediate rail having a ramp and a raised surface, said ramp defining an outermost portion of said intermediate rail and extending upwardly from said outer surface to said raised surface, said intermediate rail being adapted to be received by an edge groove on a wall panel, an inner flange terminating at said inner surface, and an inner channel extending laterally between said intermediate rail and said inner flange adapted to receive an inner leg on a wall panel when such wall panel is positioned with said intermediate rail in the edge groove of such wall panel.

15. The sill of claim 14, and further including means adapted for securing said sill to a supporting structure including a plurality of spaced holes through said intermediate rail adapted to receive securing members for engaging a supporting structure, and means adapted for securing said inner flange to an inner leg on a wall panel including a plurality of spaced holed through said inner flange adapted to receive securing members for engaging the inner leg on a wall panel.

16. The sill of claim 15, and further including a moisture barrier adapted to form a seal between said intermediate rail and a wall panel along the length of said intermediate rail.

17. The sill of claim 16, and further including a moisture barrier adapted to form a seal between said sill and the supporting structure along the length of the sill.

* * * * *